US006198408B1

(12) United States Patent
Cohen

(10) Patent No.: US 6,198,408 B1
(45) Date of Patent: Mar. 6, 2001

(54) METHOD AND APPARATUS FOR CONTROLLING ELECTRICAL APPLIANCES BY REMOTE CONTROL TRANSMITTERS

(76) Inventor: Elihay Cohen, 157 Ben Yehuda Street, Tel Aviv 63403 (IL)

( * ) Notice: Subject to any disclaimer, the term of this patent is extended or adjusted under 35 U.S.C. 154(b) by 0 days.

(21) Appl. No.: 09/057,810

(22) Filed: Apr. 9, 1998

Related U.S. Application Data

(63) Continuation-in-part of application No. 08/563,083, filed on Nov. 27, 1995, now abandoned.

(30) Foreign Application Priority Data

Nov. 29, 1994 (IL) ..... 111819

(51) Int. Cl.[7] ..... G08C 19/00

(52) U.S. Cl. ..... 340/825.69; 359/142; 455/151.4; 340/825.72

(58) Field of Search ..... 340/825.69, 825.72, 340/825.22; 348/734; 359/142; 455/151.4

(56) References Cited

U.S. PATENT DOCUMENTS 4,905,279 2/1990 Nishio .
5,081,534 1/1992 Geiger et al. .
5,099,193 * 3/1992 Moseley et al. ..... 323/324
5,386,251 * 1/1995 Movshovic ..... 348/734
5,608,389 * 3/1997 Matsuzawa ..... 340/825.57
6,005,486 * 12/1999 Fridley et al. ..... 340/825.22

FOREIGN PATENT DOCUMENTS

WO 92/01968 2/1992 (WO) .

* cited by examiner

*Primary Examiner*—Michael Horabik
*Assistant Examiner*—Anthony A Asongwed
(74) *Attorney, Agent, or Firm*—Norris, McLaughlin & Marcus P.A.

(57) ABSTRACT

A method and apparatus for controlling an electrical appliance by means of a command signal transmitted by a particular remote control transmitter, by means of a converter device which includes a receiver for receiving the command signal, a microprocessor for converting the command signal, according to a predetermined conversion process compatible with various types of command signals, to a code unique to that particular remote control transmitter, and a storage device for storing the unique code. The microprocessor may be programmed to operate in a Learn Mode to convert the command signal according to the predetermined conversion process to the unique code, and to store the unique code, and then to operate in an Operational Mode to convert any subsequently-received command signal to a code according to the predetermined conversioned process, to compare the two codes, and to effect the control of the electrical device when a match is found to be present.

6 Claims, 16 Drawing Sheets

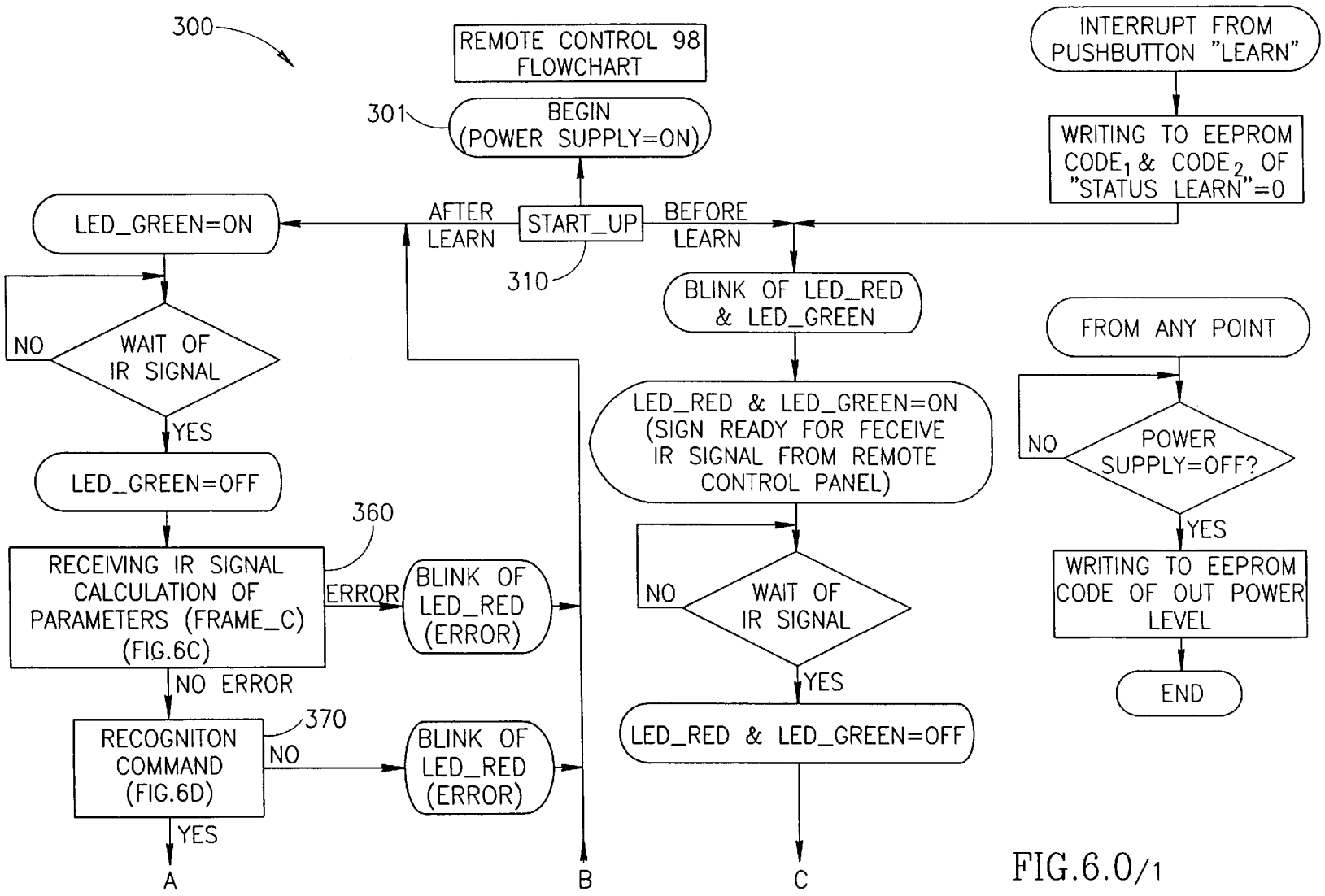
FIG.6.0/1

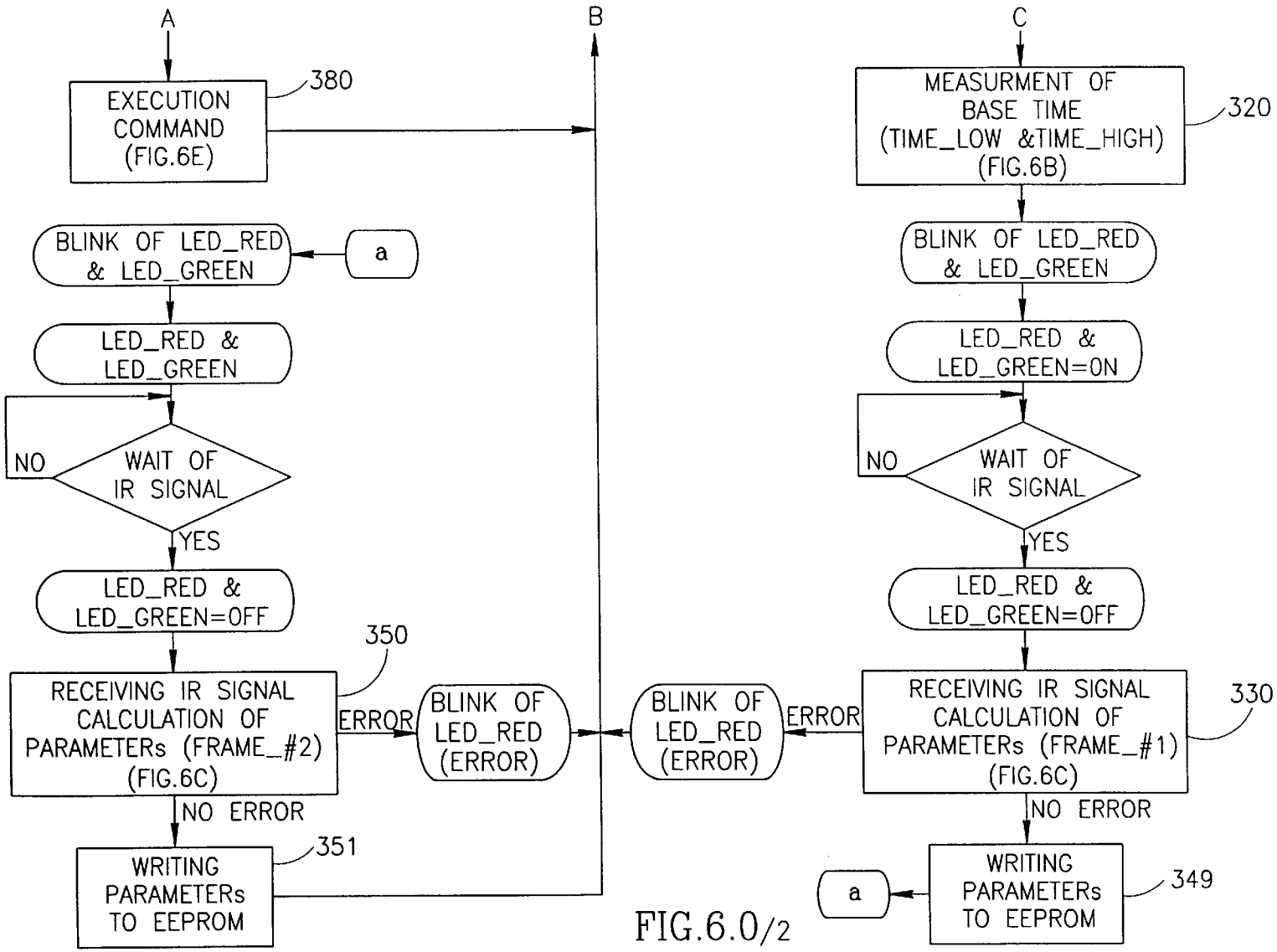
FIG.6.0/2

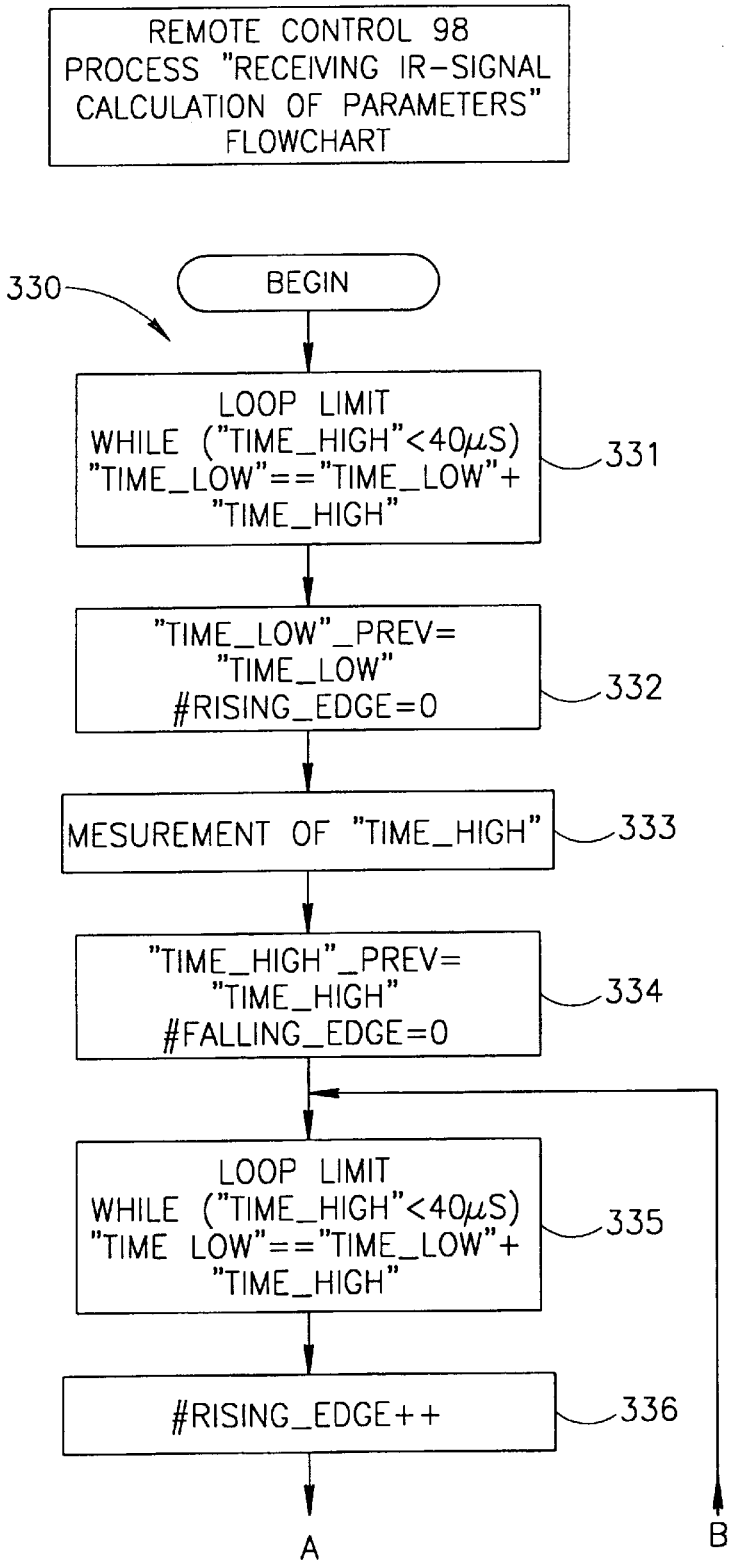
FIG.6C/1

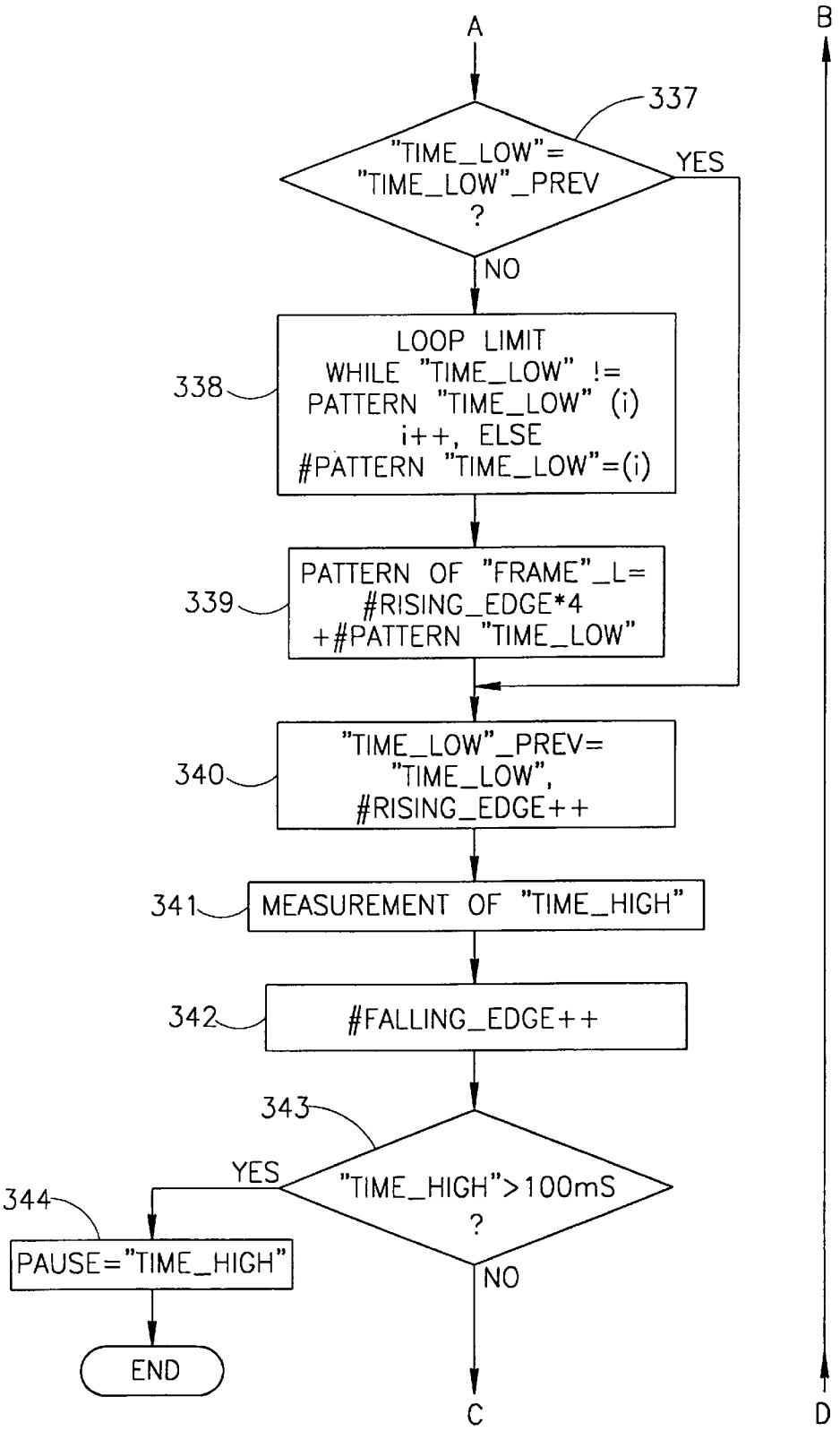
FIG.6C/2

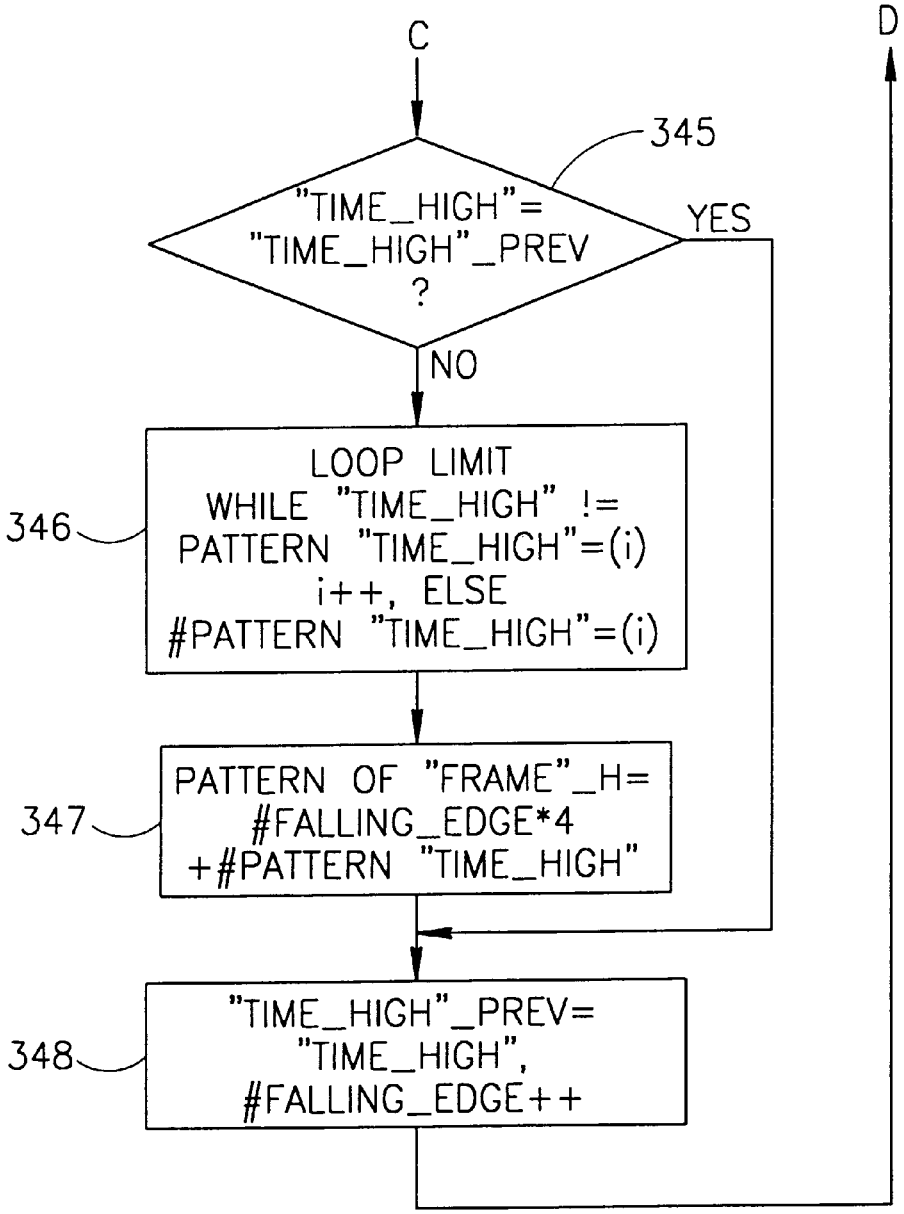
FIG.6C/3

| SIGNAL PATTERNS | HIGH | LOW |
|---|---|---|
| No.1 | 10 | 20 |
| No.2 | 20 | 10 |
| No.3 | 30 | 40 |
| No.4 | 0 | 0 |

$RE_0=(0X4)+1=1$ $RE_1=(1X4)+2=6$ $RE_3=(3X4)+3=15$ $FE_0=(0X4)+1=1$ $FE_1=(1X4)+2=6$ $FE_4=(4X4)+3=19$

METHOD AND APPARATUS FOR CONTROLLING ELECTRICAL APPLIANCES BY REMOTE CONTROL TRANSMITTERS

RELATED APPLICATION

The present application is a continuation-in-part of application Ser. No. 08/563,083 filed Nov. 27, 1995, now abandoned.

FIELD AND BACKGROUND OF THE INVENTION

The present invention relates to a method and apparatus for controlling an electrical appliance by means of a remote control transmitter.

Remote control of electrical appliances, such as television sets, light fixtures, fans, and the like, is well known in the art. Generally, each remote control transmitter is dedicated to control a particular appliance. This means that the user must be equipped with a large number of such remote control transmitters if a large number of appliances are to be remotely controlled. The need to have a remote control transmitter for each appliance to be remotely controlled increases the costs and decreases the convenience, in providing the advantages of remote control for the many types of appliances normally operated by a user.

Providing converter devices for remote control transmitters to adapt them for operating different types of appliances via a Learn Mode has also been proposed, as for example, described in U.S. Pat. Nos. 4,905,279, 5,081,534, but apparently, such converter devices have not found wide spread use.

OBJECTS AND SUMMARY OF THE PRESENT INVENTION

An object of the present invention is to provide a novel method of controlling an electrical appliance by means of a remote control transmitter by using a converter device which can be programmed in a Learn Mode to Learn the command signal of the common types of remote control transmitters, and to produce a code unique to one particular remote control transmitter so that the same remote control transmitter, can be used for operating all electrical appliances equipped with such a converter device and programmed to learn the transmitter's command signal.

Another object of the present invention is to provide apparatus for use in the above method.

According to one aspect of the present invention, there is provided a method of controlling electrical appliances by means of a command signal transmitted by a particular remote control transmitter, comprising: providing a converter device which includes a receiver for receiving the command signal, a microprocessor for converting the command signal according to a predetermined conversion process compatible with various types of command signals, to a code unique to that particular remote control transmitter, and a storage device for storing the unique code; transmitting to the converter device a command signal from the particular remote control transmitter while the microprocessor is programmed in a Learn Mode to convert the command signal according to the predetermined conversion process to the unique code, and to store the unique code in the storage device; and subsequently transmitting to the converter device another command signal from the particular remote control transmitter, while the microprocessor is programmed in an Operational Mode, to convert the latter command signal to a code according to the predetermined conversion process, to compare the latter code with the code produced and stored during the Learn Mode, and to effect the control of the electrical device when a match is found to be present between the code produced and stored during the Learn Mode and the code produced during the Operational Mode.

According to further features in one described preferred embodiment, the microprocessor is programmed to effect a first control if the time duration of another subsequently-transmitted command signal, as received by said converter device, is below a predetermined time duration, and to effect a second control if the time duration of another subsequently-transmitted command signal is equal to or above the predetermined time duration. In the described preferred embodiment, the first control is an On/Off control, and the second control is a Power-Varying control, such as a Dimmer control for a light fixture.

According to another aspect of the invention, there is provided apparatus for controlling an electrical appliance by means of a command signal transmitted by a particular remote control transmitter, comprising: a converter device including a receiver for receiving the command signal, a microprocessor for converting the command signal, according to a predetermined conversion process compatible with various types of command signals, to a code unique to that particular remote control transmitter, and a storage device for storing the unique code. The microprocessor is programmed to execute a Learn Mode when receiving, during the Learn Mode, a first command signal transmitted by the particular remote control transmitter to convert the first command signal to the unique code according to the predetermined conversion process, and to store the unique code in the storage device. The microprocessor is also programmed to execute an Operational Mode when receiving, during the Operational Mode, a second command signal from a remote control transmitter, to convert the second command signal to a code according to the predetermined conversion process, to compare the latter code with the code produced and stored during the Learn Mode, and to effect the control of the electrical device when a match is found to be present between the code produced and stored during the Learn Mode and the code produced during the Operational Mode.

As will be described more particularly below, the method and apparatus of the present invention permit a wide variety of electrical appliances to be remotely controlled with a minimum of expense and inconvenience to the user. In addition, the remote control may be a mere On/Off control or may involve other controls, such as a Dimmer control for a lighting device.

Further features and advantages of the invention will be apparent from the description below.

BRIEF DESCRIPTION OF THE DRAWINGS

The invention is herein described, by way of example only, with reference to the accompanying drawings, wherein:

FIG. 6 is a flow chart illustrating the overall operation of the apparatus of FIG. 5;

FIGS. 6A–6E are flow charts illustrating specific routines in the flow chart of FIG. 6.

DESCRIPTION OF PREFERRED EMBODIMENTS

The Embodiments Of FIGS. 1A–3B

Figure 1A:
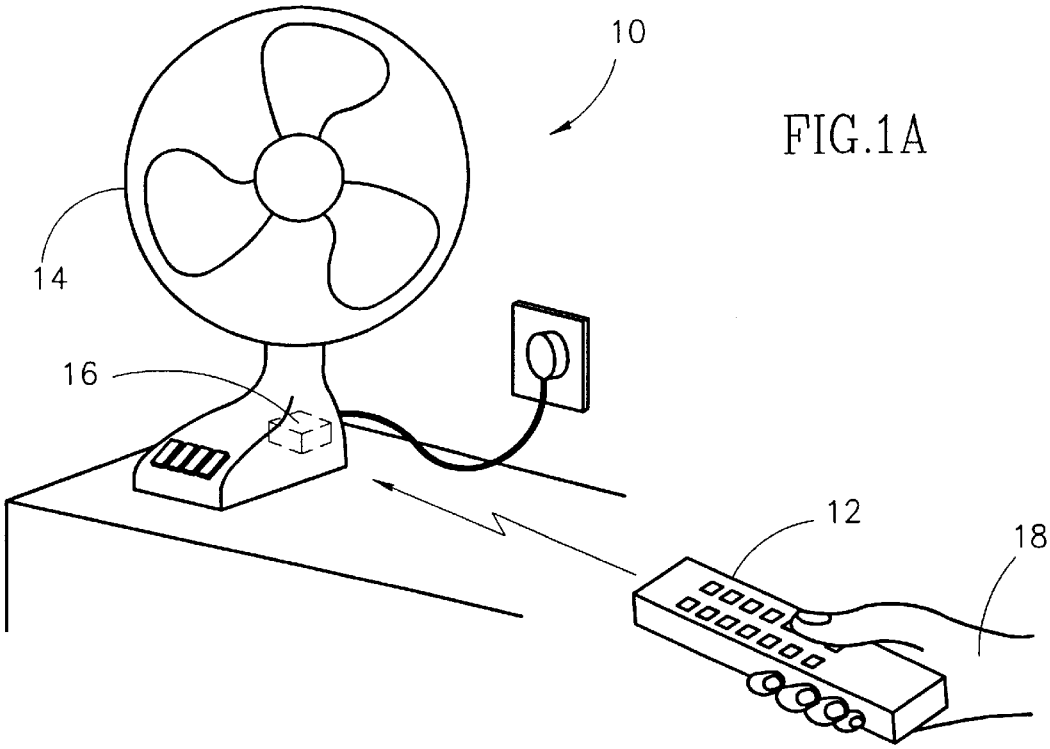
FIG. 1A is a schematic illustration of a remote control switching system constructed in accordance with a preferred embodiment of the present invention, in which a converter device capable of being programmed to respond to a signal from a particular remote control unit is incorporated in an electrical appliance.
Figure 1B:
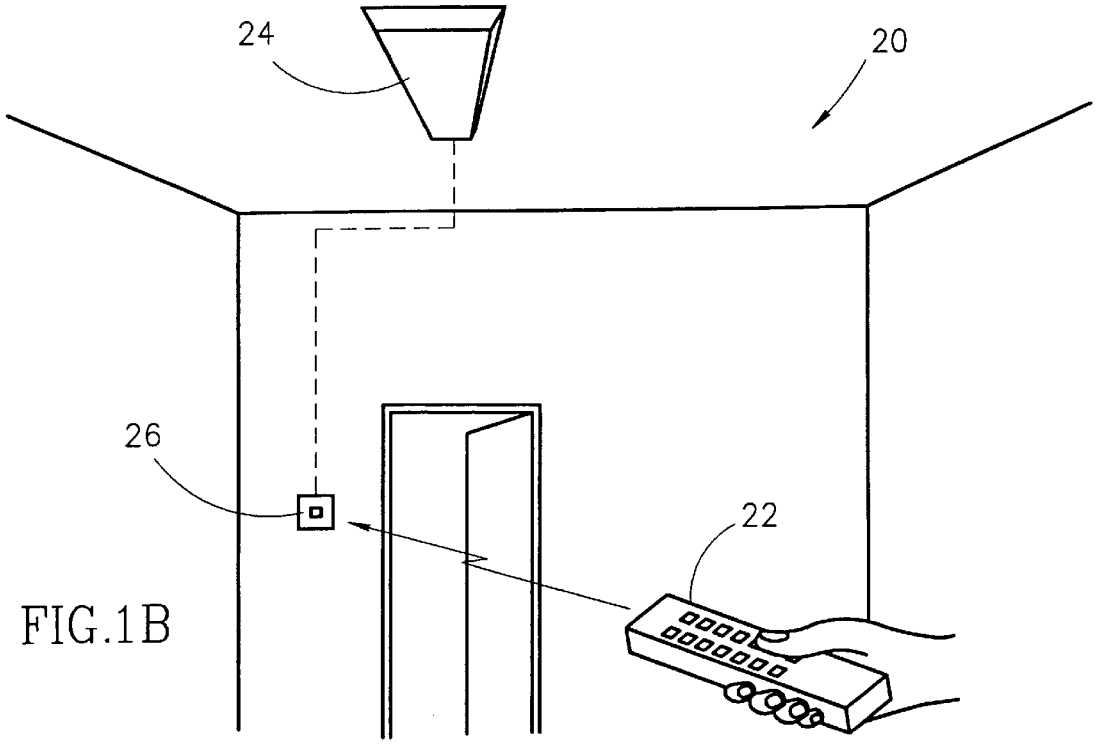
FIG. 1B is a schematic illustration of a remote control switching system, constructed in accordance with another preferred embodiment of the present invention, in which the converter device is incorporated in the electrical supply network.
Figure 1C:
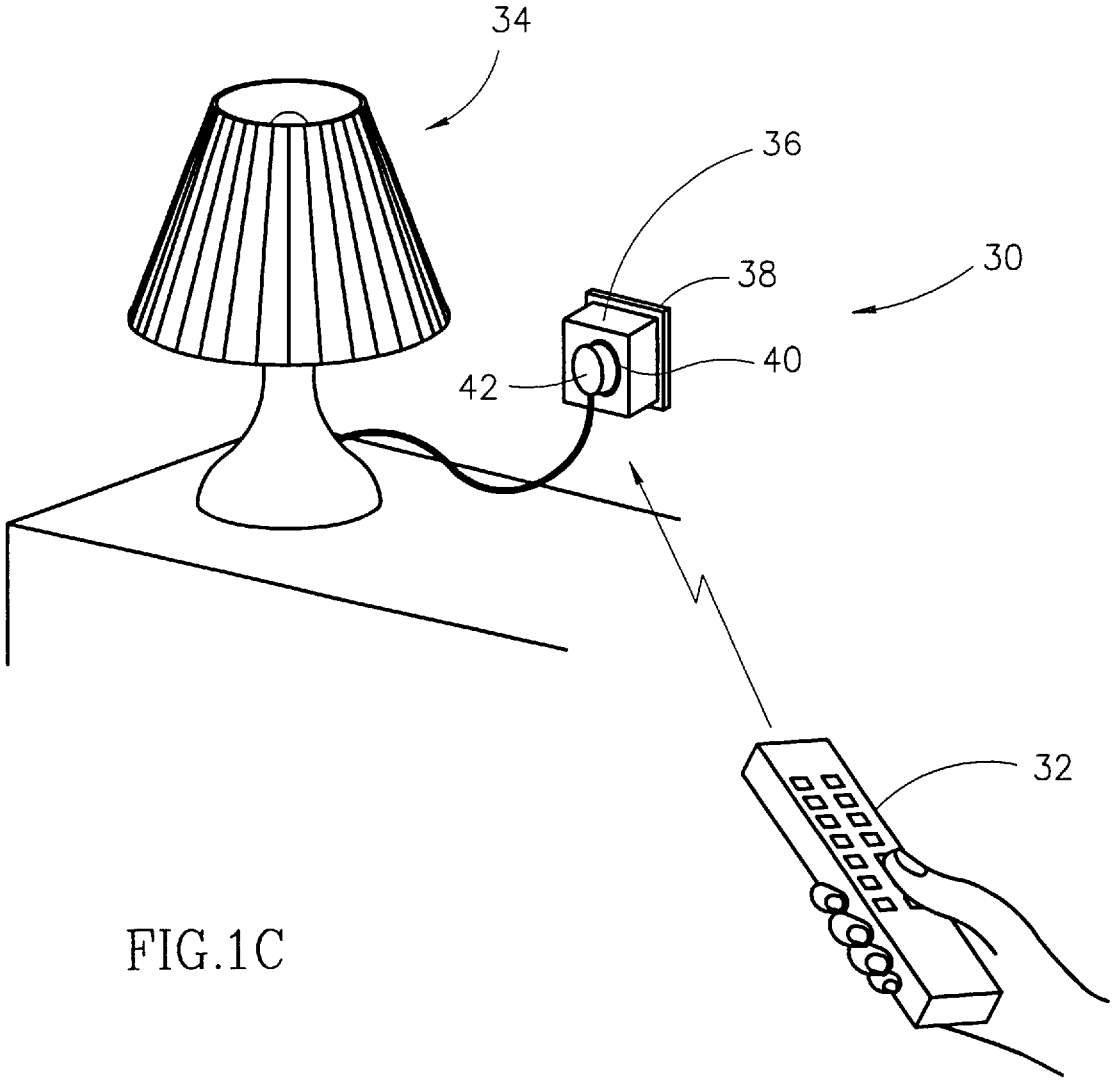
FIG. 1C is a schematic illustration of a remote control switching system, constructed in accordance with yet another preferred embodiment of the present invention, in which the converter device is incorporated in an adapter to be plugged into a socket of an electrical supply network.

Reference is now made to FIGS. 1A, 1B and 1C which are schematic illustrations of a remote control switching system which employs a device capable of receiving a signal from a remote control unit, constructed according to three preferred embodiments of the present invention. All these embodiments employ a device capable of receiving a signal from a remote control unit for switching an electrical current on and off.

The system of FIG. 1A, referenced generally 10, preferably comprises a remote control unit 12 which turns a fan 14 on and off via a switch 16. It will be appreciated that the system 10 may include any electrical appliance, such as a radio or an electrical radiator, and that the fan 14 is presented herein only for exemplary purposes.

Fan 14 preferably comprises a remotely controlled switch 16 which is incorporated in the fan and is programmed to switch on and off the fan in accordance with a signal transmitted from a remote control unit 12 by a user 18 (for simplicity only the hand of the user is shown). Switch 16 operates in two modes: a Learn Mode, and an Operational Mode as described in more detail below. In the Learn Mode, the switch receives a signal transmitted from remote control unit 12, converts it to a code unique for that unit, and stores it. At any subsequent time switch 16 receives a signal from the remote control unit 12, it compares the received signal with the stored signal, and switches fan 14 on or off if a match is found to exist.

It is a particular feature of the present invention that the switch 16 may be programmed to be responsive to signals from a particular remote control unit. Accordingly, the remote control unit 12 may be any suitable device, such as the television cable network remote control unit. Typically, the remote control unit is an Infra Red (IR) device.

The system of FIG. 1B, generally referenced 20, comprises a remote control unit 22 and a remotely controlled switch 26 which switches the light in the light bulb 24 on and off. The system 20 illustrates the implementation of the switch 26 in the electrical supply network, typically in a household electrical supply. Remote control unit 22 may be similar to remote control unit 12 of FIG. 1A, and switch 26 may be similar to switch 16.

It is a particular feature of the present invention that the device capable of receiving a signal from any remote control unit may be implemented in an existing electrical appliance or in an electrical network. Alternatively, it may be a stand alone device in the form of an adapter to connect an electrical appliance to the electrical supply network.

FIG. 1C illustrates such a system, generally referenced 30, comprising a remote control unit 32 and a switch 36 which switches a table lamp 34 on and off. Switch 26 is an independent unit incorporated into an adapter including a plug (not shown) for plugging the switch 36 into any suitable socket 38, and a socket 40 for receiving the plug 42 of an electrical appliance, such as the lamp 34.

Figure 2:
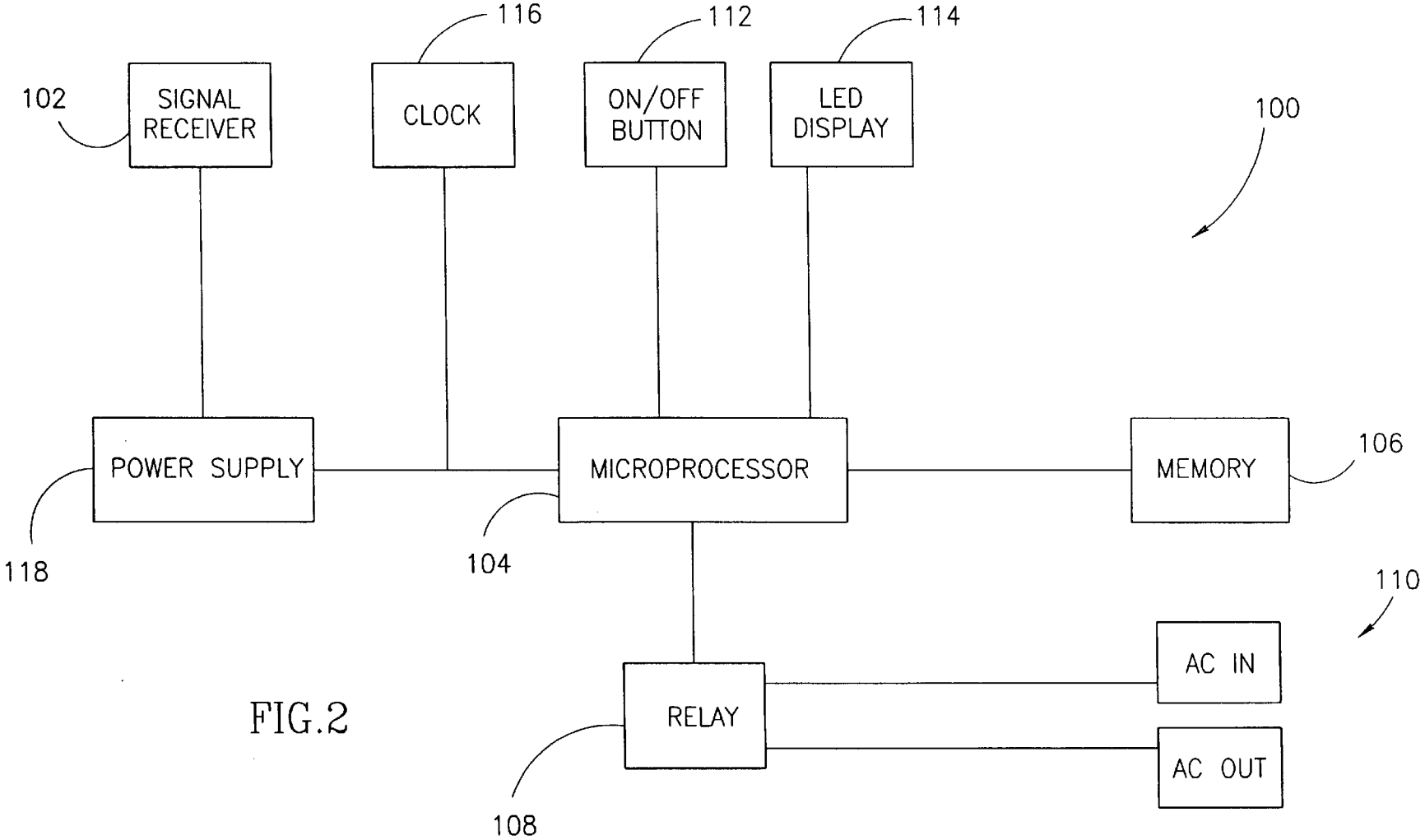
FIG. 2 is a block diagram illustrating the main components in one form of apparatus constructed in accordance with the present invention.

Reference is now made to the block diagram of FIG. 2 schematically illustrating a remotely-controlled switch, such as switch 16 of FIG. 1A, switch 26 of FIG. 1B, or switch 36 of FIG. 1C. The switch of FIG. 2 is generally referenced 100 and preferably comprises a signal receiver 102 for receiving a signal from any suitable remote control unit, such as an IR remote control device; a microprocessor 104 for processing the signal received by the signal receiver 102 to convert it to a code unique for that particular remote control unit, and a memory 106 for storing the uniquely-coded signal. Switch 100 further includes a relay 108 which receives an instruction from the microprocessor 104 and switches on and off the AC current from the AC source 110. It will be appreciated that the current source may be a DC source as well.

Signal receiver 102 preferably comprises an IR signal receiver and amplifier, provided that the remote control is of the IR (infrared) type, such as the OTECO signal receiver and amplifier. Microprocessor 104 may be any suitable microprocessor, preferably a programmable one, such as the MOTOROLA XC68HC805C4CP microprocessor. Memory 106 may be any suitable memory, such as the ATMEL AT24C01; and relay 108 may be any suitable mechanical, electrical or electronic relay, such as the MOTOROLA MOC3043 with the R910 60738 optotriac.

Switch 100 preferably also comprises an On/Off 112 button for turning the switch itself on and off, and a light emitting diode (LED) display 114 for providing an indication of the state of the switch 100. Switch 100 preferably also includes a system clock 116, such as ASA 4.0 Mhz crystal which sets the operation frequency of the microprocessor, and a DC power supply 118.

Figure 3B:
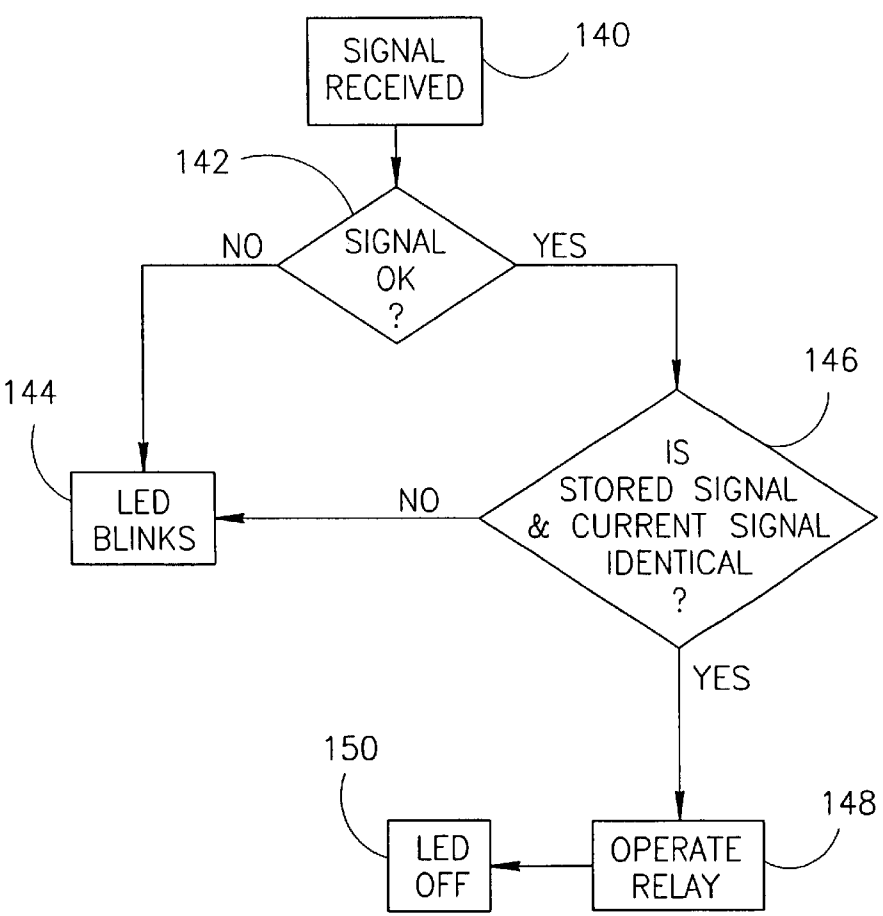
FIGS. 3A and 3B are flow charts illustrating the operation of the apparatus of FIG. 2 in two modes of operation.
Figure 3A:
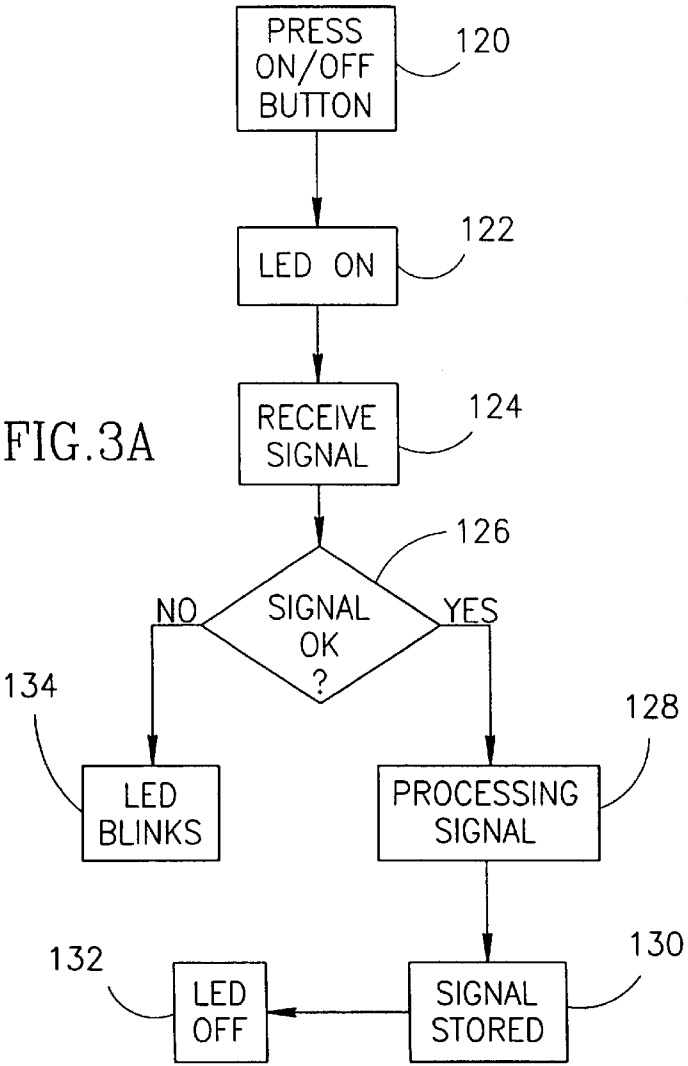

Reference is now made to FIGS. 3A and 3B which are flow charts illustrating the operation of switch 100 in its two modes of operation: a Learn Mode (FIG. 3A); and an Operational (on/off) mode (FIG. 3B).

In the Learn Mode, switch 100 receives a signal from the remote control unit and stores it after processing to convert it to a unique code to be compared with any subsequent signal received from a remote control unit. To initiate the Learn Mode, the On/Off button 112 is pressed (block 120). In response, the LED display 114 turns on (block 122). The switch 100 is then ready to receive a signal from the remote control unit (block 124). Preferably, the user selects a function button in any available remote control unit which is not used for controlling the operation of another appliance in order to dedicate it to the operation of the switch 100. Alternatively, any function button can be selected.

The signal is examined by the microprocessor 104 which determines its characteristics as indicated by block 126. If the signal meets the characteristics of a typical IR remote command signal, it is processed by the microprocessor 104 (block 128) and converted to a unique code which is stored in the memory 106 (block 130). The LED display 114 turns off to indicate that the learning processes of the remote command signal has been successfully completed (block 132).

If the signal does not meet the characteristics of a typical remote command signal, the LED display 114 blinks (block 134). This indicates that the switch 100 failed to learn the remote command signal, and the learning process starts from its beginning as described above.

It will be appreciated that if the learning processes is successful, it will be repeated only if and when the user decides to operate the switch 100 with a different remote control unit, or with an alternative code of the same remote control unit.

In the On/Off Operational Mode, the user switches the appliance(e.g., a, the light, or any other suitable electrical appliance) on and off. The On/Off Operational Mode starts with a signal sent from the remote control unit by the user. The received signal (block 140) is examined (block 142) to determine whether it has the characteristics of a remote command signal similarly to step 126 of the Learn Mode. If the signal fails to meet these characteristics, the LED display blinks (block 144), and another signal has to be sent by the remote control unit.

If the signal meets the characteristics of a remote command signal, it is compared by the microprocessor 104 with the unique code generated and stored in the memory 106 during the Learn Mode, (block 146). If the two match, an indication to the relay 108 is provided, and the relay 108 turns off or on the electrical current passing through the switch 100 in accordance with the status of the switch (block 148). The LED display 114 of FIG. 2 turns off to indicate successful completion of the operation of the switch 100 (block 150). If the two signals do not match, the LED display 114 of FIG. 2 blinks (block 144) and the process starts from its beginning.

The Embodiment of FIGS. 4A–7

Figure 4A:
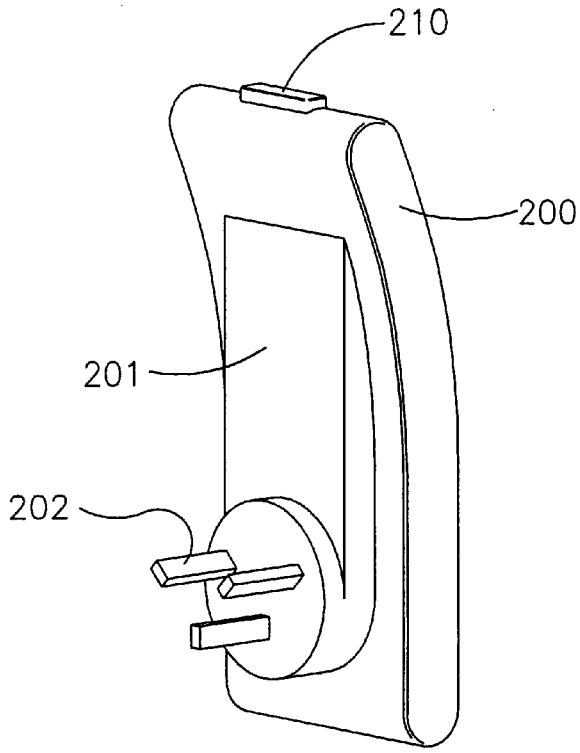
FIGS. 4A and 4B are three-dimensional views illustrating, from the opposite sides, one form of apparatus constructed in accordance with the present invention embodied in an adapter including a plug for plugging into the conventional electrical supply line, and a socket for receiving the line plug of the electrical appliance to be remotely controlled.
Figure 4B:
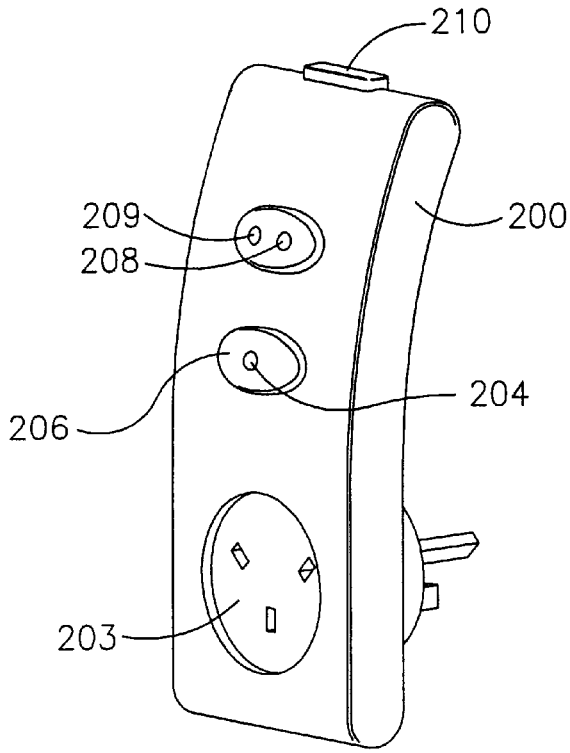

FIGS. 4*a* and 4*b* pictorally illustrate the opposite sides of a converter device also constructed in accordance with the present invention, to be used as an adapter, similar to the switch 36 illustrated in FIG. 1C. The adapter illustrated in FIGS. 4A and 4B, therein generally designate 200, includes a housing 201 formed with a plug 202 on one side for plugging into a socket of the household electrical supply, and a socket 203 at the opposite side for plugging in an electrical appliance, such as a fan or lamp as illustrated in FIGS. 1A and 1C, respectively. The side of housing 201 including the socket 203 is formed with an opening 204 centrally of a semi-circular depression 206 for exposing a photoreceiver 207 (FIG. 5), located within the housing, to the infrared signal to be sent by a remote control transmitter unit, such as unit 12, 22 or 32 in FIGS. 1A, 1B and 1C, respectively.

Adapter 200 further includes a red LED light indicator 208, a green LED light indicator 209, and a depressable Learn button 210 for conditioning the adapter for operation in the Learning mode.

Figure 5:
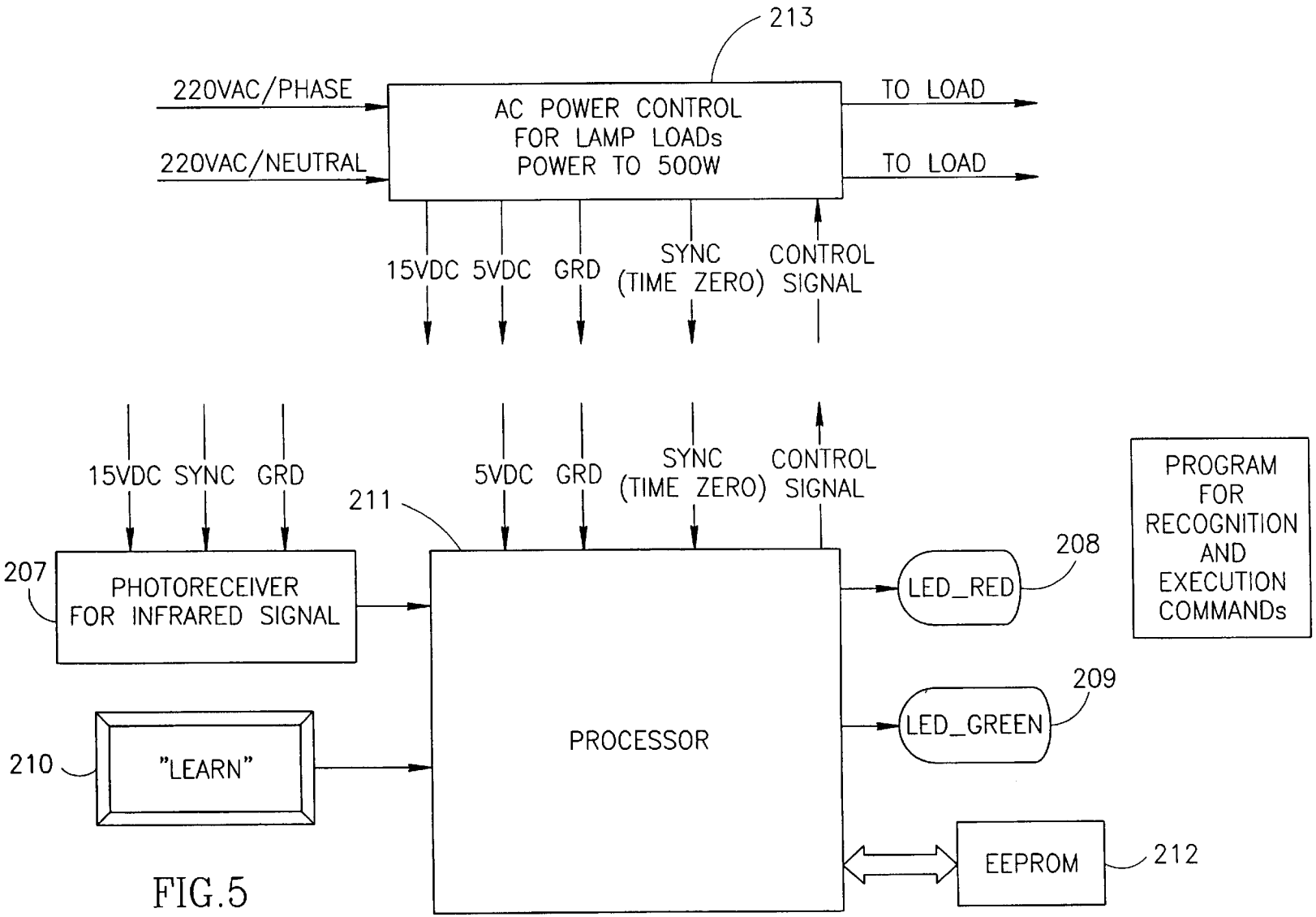
FIG. 5 is a block diagram illustrating the electrical circuit in the device of FIGS. 4A and 4B.

FIG. 5 illustrates the electrical system within housing 201 of adapter 200. As shown, the electrical system includes, in addition to the photoreceiver 207, the LED light indicators 208, 209, and the Learn button 210, a microprocessor 211, a memory 212, and a power supply 213. Microprocessor 211 is programmed to operate according to the Learning Mode and the Operational Mode, as described below with respect to the flow chart of FIGS. 6 and 6A–6E, depending on whether or not the Learn button 210 is depressed; memory 212 is preferably an EEPROM for storing the unique code generated by the microprocessor from the signal received from the particular remote control transmitter unit operated during the Learning Mode; and power supply 213 may include circuitry for utilizing power from the household electrical network for operating the adapter, as well as for supplying the electricity to the electrical appliance.

The operation of the system is described in the overall flow chart of FIG. 6, and the specific routine of flow chart of FIGS. 6A–6E.

As shown in the overall flow chart of FIG. 6, the microprocessor 211 is programmed to execute a Learning Mode if the Learn button 210 is depressed, and if not, to execute an Operational mode. Briefly, when in the Learn Mode, the microprocessor 211 converts any signal received by the photoreceiver 207 from a remote control transmitter (e.g., 12, 22, 32) to a code which is unique to that particular remote control transmitter, and stores the code in EEPROM 212. When the microprocessor is in the Operational mode, any signal received by its photoreceiver 207 will be processed in the same manner to convert the signal to a code. The latter code is compared with that stored during the Learn mode, and if a match is found to be present, the system effects a predetermined control function with respect to the electrical appliance plugged into its socket 203.

An important feature of the present invention is that microprocessor 211 is programmed to convert the received command signal to a unique code according to a pretermined conversion process which is compatible with all the commonly-used types of remote control transmitters and is capable of producing a code unique to the particular remote control transmitter used during the Learn Mode. Another important feature is that more than one control function can be effected with respect to the electrical appliance; in the example described below, an On-Off control is effected if the transmitter command signal is below a pretermined time duration; and a Power-Varying control, such as a Dimmer control, is effected if the duration of the transmitted command signal is equal to or above a pretermined time duration.

Figure 6A:
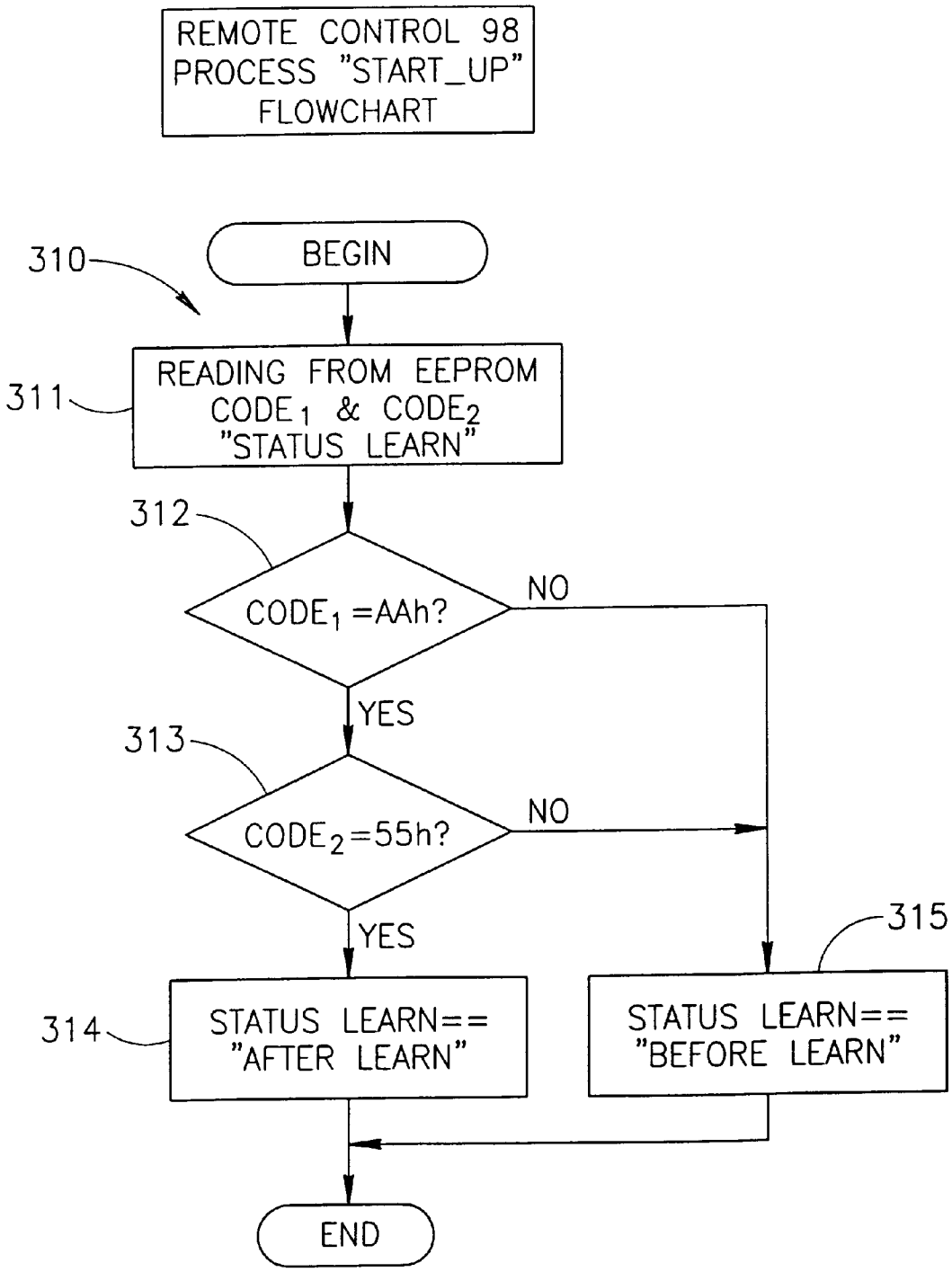
Figure 6B:
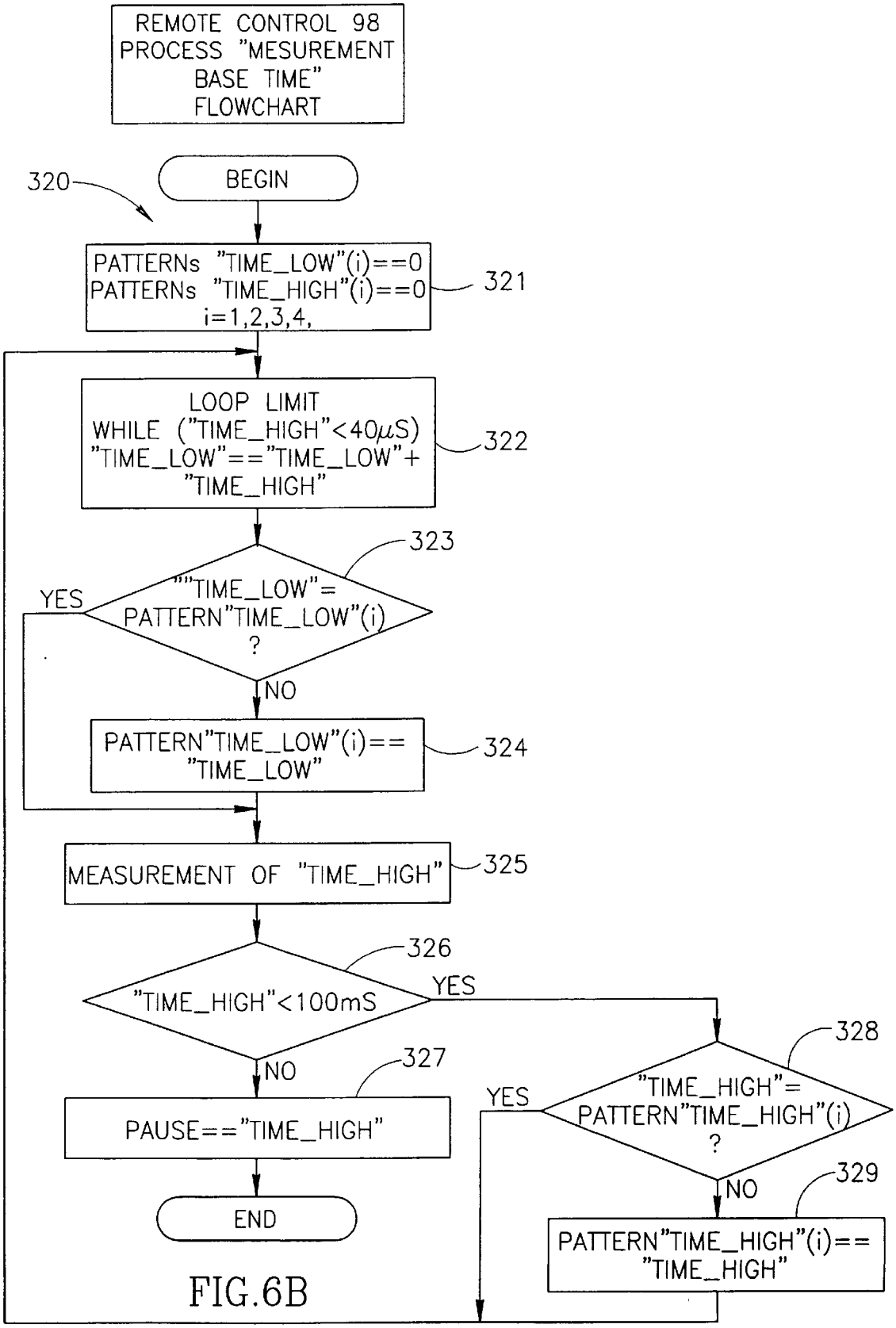
Figure 6D:
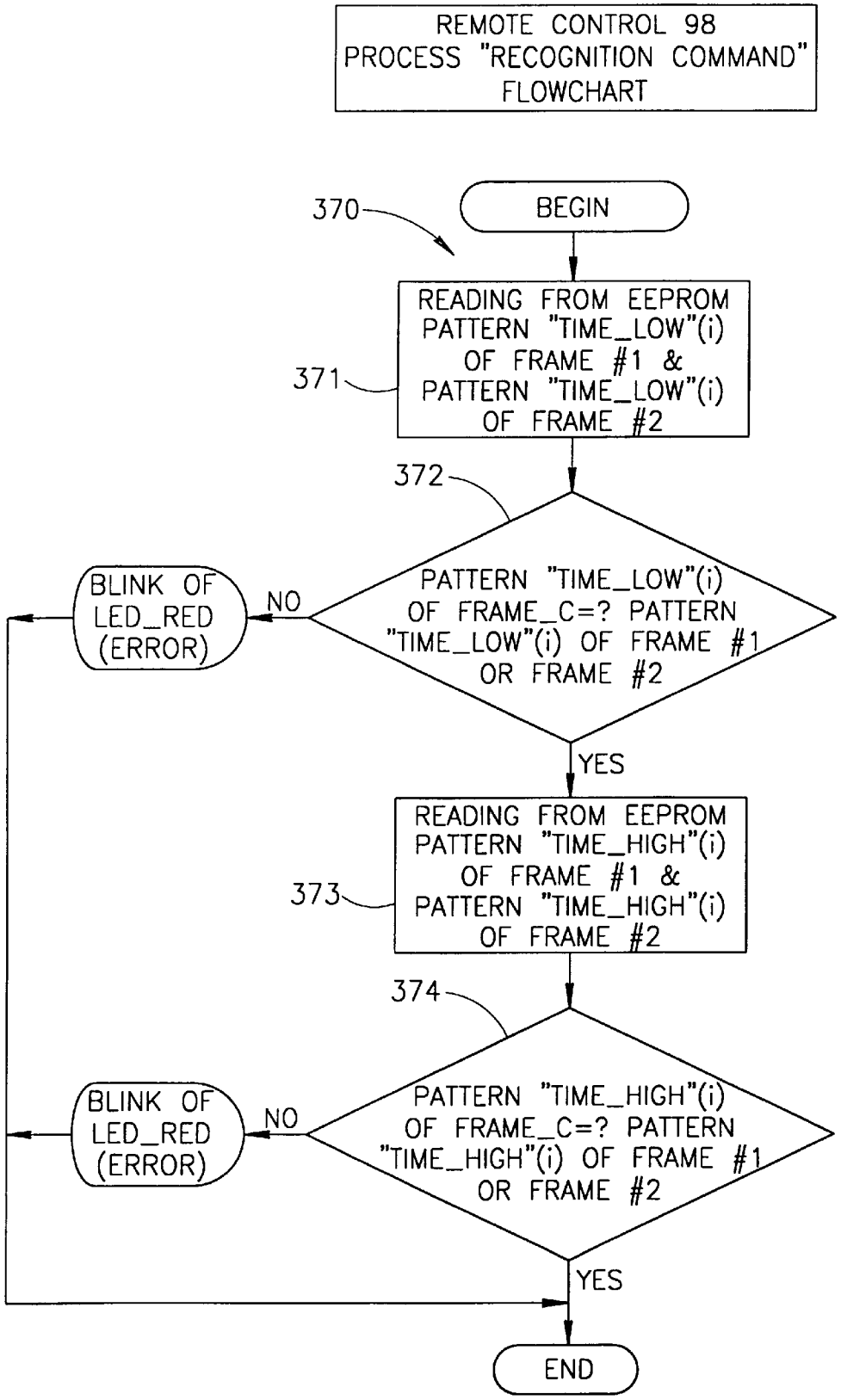

The overall flow chart illustrated in FIG. 6, therein generally designated 300, includes a Start-up routine (block 310), more particularly illustrated in FIG. 6A. The purpose of this routine is to identify whether the device has already learned the unique code of a remote control transmitter unit. As shown in FIG. 6A, this is done by reading from memory 212 two codes (311), which are stored in memory 212 only as a result of successfully learning a code in the Learn Mode. Both codes must be found to be present (blocks 312, 313) to permit the device to operate according to the Operational mode (block 314); otherwise, it must operate according to the Learn Mode (block 315).

To operate the device according to the Learn Mode, the Learn button 210 must be first depressed, and then the remote control transmitter to be subsequently used for operating the device must be depressed three times to transmit its command signal three times. Upon receipt of the command signal produced by the first depression, the software executes the routine illustrated by block 320 in FIG. 6, and more particularly shown in the flow chart of FIG. 6B; upon receipt of the command signal produced by the second depression, the software executes the routine illustrated by block 330 in FIG. 6 and more particularly in FIG. 6C. Upon receipt of the command signal produced by the third depression, the software executes the routine illustrated by block 350 in FIG. 6, which is the same routine as in block 330, more particularly in FIG. 6C.

Remote control transmitters of this type generally transmit pulse-width-modulated command signals. Microprocessor 211 is programmed to convert the command signal received from any such transmitter to a code unique for the particular transmitter unit by a conversion process which is compatible with all the commonly-used transmitters, and then to store the unique code in its memory 212. In the preferred embodiment of the invention described below, memory 212 has a capacity of 128 bytes, each byte being composed of eight bits for storing a word. The conversion process, as described more particularly below, utilizes the changes in the rising points, the falling points, and the lengths of the pulses and spaces, in the command signal, to convert the command signal to the unique code stored in the memory.

As indicated earlier and as shown in the flow chart of FIG. 6, the conversion process is effected in three stages, each stage being initiated by the actuation of the remote control transmitter unit to transmit its command signal.

In the first stage, microprocessor 211 is programmed (via routine 320, shown in FIG. 6B) to detect the width of the pulses and spaces in the command signal transmitter in the first depression, and to classify them in up to four classes; this data is used for supplying up to nine bytes of the unique code stored in memory 212.

In the second stage, microprocessor 211 is programmed (via routine 330, shown in FIG. 6C) to detect each change in a pulse rising point and a pulse falling point in the command signal transmitter in the second depression, and to combine each such change with the class of the respective pulse as classified in the first stage; this data is used for supplying up to 58 bytes of the unique code stored in the memory.

In the third stage, the microprocessor is programmed (via routine 340, also shown in FIG. 6C) to process the command signal transmitted by the transmitter unit in the third depression in the same manner as it processed the command signal in the second stage, for supplying up to an additional 58 bytes of data to be stored in the memory. This third stage in the conversion process, effected by the third depression of the transmitter unit, is provided in order to make the conversion process compatible with transmitter units which require two actuations and transmit two different command signals.

The overall flow chart illustrated in FIG. 6 also includes the operation of the red light indicator 208 and the green light indicator 209, as follows: When both are "off", this indicates that system is receiving a signal; when both are "on", this indicates the system has successfully completed stages 1 and 2 of the Learn mode; when the green is "on", this indicates that the system had successfully completed stage 3 of the Learn Mode; when the red "blinks", this indicates the system is in an Error status; and when both blink, this indicates the system has not started the Learn Mode.

The operation of the embodiment of FIGS. 4A–7 will now be described with reference to the overall flow chart of FIG. 6, and the specific routines therein as illustrated in the flow charts of FIGS. 6A–6E:

When the power supply to the device is turned on (block 301), the software executes as "start-up" routine (block 310) to determine whether the system is in the Learn Mode to learn a command signal, or not. The start up routine 310, as more particularly illustrated in FIG. 6*a* and described above, determines that the learning process has been completed only if the two codes stored in the memory during the learning process are found to be present, in which case the system proceeds to the Operational mode. If, however, one of the two codes is not found to be present, the system will operate only according to the Learn Mode in order to learn the identity of the command signal to be effective for operating the system.

The Learn mode is executed by the depression of the Learn button 210 which clears the memory 212 of the two codes.

Assuming the system is in the Learn mode, it will execute the first stage of the learning process upon the first depression of the transmitter unit button, indicated by block 320 in FIG. 6. As described earlier and as more particularly illustrated in FIG. 6B, in this first stage, the system detects the width of the pulses and spaces in the command signal received upon the first depression of the transmitter unit button, and classifies them in up to four different classes. This is done by measuring two types of signals: "HIGH" and "LOW". The HIGH signal represents either no signal received from the remote transmitter, or a very short gap (no longer than 40 $\mu$S) in the signal transmitted by the remote unit. Generally, in such pulse-width-modulated command signals, a signal frame includes a maximum of four sizes of pulses, and four sizes of spaces. A gap of more than 100 mS indicates the end of a command frame.

Figure 7:
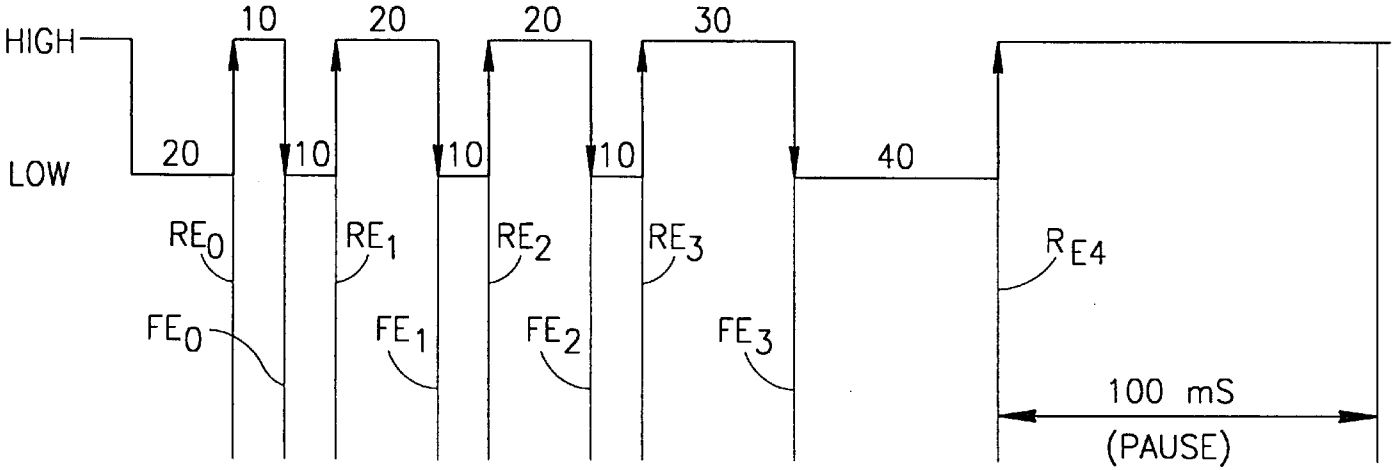
FIG. 7 is a diagram helpful in explaining the operation of the apparatus according to the flow charts of FIGS. 6 and 6A–6D.

FIG. 7 illustrates an example of a command frame, including the HIGH's and LOW's defining the pulse widths and space widths of the command signal, and also including the 100 mS Pause indicating the end of the command frame. In this example, there are three sizes of High's (pulses) representing three classes of pulse lengths (10, 20, 30), and three sizes of Low's (spaces) representing three sizes of pulse spaces (10, 20, 40). Accordingly, the signal patterns will be as shown in the box in FIG. 7. Four bytes of the memory are used for recording the different lengths of pulses, and four additional bytes are used for recording the different lengths of the spaces in the command signal. When a command signal includes less than four different sizes of pulses or spaces, a "0" is recorded for that byte. The ninth byte is used for recording the "Pause" indicating the end of a command frame.

Thus, in the example of the command signal illustrated in FIG. 7, the nine bytes of the memory allocated for the first stage in the conversion process would appear as follows: bytes 1–4 for recording the "High's" would be 10, 20, 30, 0; bytes 5–8 for recording the "Low's" would be 20, 10, 40, 0; and the ninth byte would be for recording the "Pause".

Stage 2 in the Learn Mode is effected by the routine of block 330 in flow chart of FIG. 6, which is executed upon the second depression of the remote control transmitter unit button. This routine is more particularly illustrated in FIG. 6C. As briefly described earlier, during this routine, the software senses each change in a pulse rising point, and a pulse falling point, and combines this data with the class of the respective pulse or space as classified in the first stage by routine 310. The second stage produces up to 29 additional bytes of data recorded in the memory for identifying the command signal produced by the remote transmitter unit. The specific steps involved in performing this routine are more particularly illustrated by blocks 331–348 in FIG. 6C.

Briefly, as set forth in steps 331–348 in the routine flow chart of FIG. 6C, a frame of the command signal received by the unit is analyzed and each falling edge and each rising edge is detected and numbered. If there is a change in a length of the pulse or space in the command signal, from the previous signal in the frame, then the respective rising and falling edge is used for determining the content of one byte of the memory, as follows: The edge reference number where the change is detected is multiplied by "four" (arbitrary) and added to the class of the respective pulse or space as determined in stage 1. This method may be used for producing up to 29 bytes of data from the pulses, an and up to an additional 29 bytes of data from the spaces, which data is recorded in the 128 byte memory 212.

FIG. 7 more particularly illustrates the performance of this method upon the receipt of the second command signal produced by the second depression of the remote transmitter unit. Thus, a change in the rising edges would be detected with respect to rising edges $RE_0$, $RE_1$, and $RE_3$; and a change in the falling edges would be detected with respect to $FE_0$, $FE_1$ and $FE_4$. Rising edge $RE_0$ includes a class 1 of pulse length, and therefore the calculation produced with respect to this rising edge would be $(0\times4)+1=1$. Rising edge $RE_1$ includes a class 2 pulse length, so that this edge would produce the number $(1\times4)+2=6$. Rising edge $RE_3$ includes a class 3 pulse length, so that this rising edge would produce the number $(4\times3)+3=15$.

Accordingly, the first three bytes of data generated during routine 330 (FIG. 6), as more particularly shown by blocks 331–348 in FIG. 6C, for recording in memory 212, would be "1", "6", "15". This process would be repeated for all the pulses in the complete command signal, to generate in this manner up to 29 bytes of data.

The same process is repeated with respect to the changes in the falling edges of the command signal. Thus, in the signal illustrated in FIG. 7, the first three bytes of data generated from the spaces would be "1", "6", "19". The process is repeated for all the spaces to generate up to an additional 29 bytes of data for recording in the memory 212 as frame No. 1.

After the parameters obtained by the second depression of the remote transmitter unit have been written in the memory (block 349, FIG. 6), the remote transmitter unit button is depressed a third time to produce the third command signal, which is received and processed according to the routine indicated by block 350 in FIG. 6. This routine is exactly the same as routine 330 as illustrated in FIG. 6*c,* and produces up to and additional 58 bytes of data for recording in the memory 212 as Frame No. 2. As indicated earlier, the purpose of recording Frame No. 2 is to accommodate transmitter units which are intended to be depressed twice and to transmit two different command signals with the two depressions.

Upon recording the up to 29 bytes generated by routine 350 in FIG. 6 in the memory (block 351), the Learn Mode is completed. The 128 byte memory will contain the unique code, as follows:

2 bytes for Learn status (see START UP)
4 bytes for LOW PATTERNS
4 bytes for HIGH PATTERNS
1 byte for PAUSE (end of frame gap length)
1 byte for STATUS DIMMER (CONTROL SIGNAL)
29 bytes for FRAME 1 PATTERN LOW
29 bytes for FRAME 1 PATTERN HIGH
29 bytes for FRAME 2 PATTERN LOW
29 bytes for FRAME 2 PATTERN HIGH After Learn Mode has been completed, the adapter may thereafter be used in the Operational mode to control the electrical device (e.g., fan, lights, or any other electrical appliances) whenever it receives a command signal matching that stored in its memory. For this purpose, the microprocessor 211 converts the received command signal to a code according to the same conversion process used in the Learn Mode, except that only one depression of the remote transmitter unit button is required, rather than three as in the Learn Mode. When the device determines a match is present between the unique code stored in its memory during the Learn Mode, and the code produced by the subsequently-received command signal, it effects the required control of the electrical device.

In the example illustrated by the flow diagrams of FIGS. 6 and 6A–6E, the microprocessor is programmed to produce a first control, namely an On-Off control, when the received command signal is detected for a time duration below a pretermined time, and a second control, such a Power-Varying or Dimmer control, when such a signal is detected for a duration equal to or above the predetermined time.

Thus, with respect to the flow chart of FIG. 6, upon receiving the command signal, the microprocessor performs the routine illustrated in block 360, which is the same routine as block 330 and 350 performed during the Learn Mode and more specifically described in the flow chart of FIG. 6C. This routine produces data corresponding to the 58 bytes produced in the routine of block 330 upon the second depression of the remote transmitter unit button. The 9 bytes of data produced during the Learn Mode upon the first depression of the remote transmitter unit is retained in the memory for use also during the Operational mode, so that the Operational mode does not require a separate depression of the remote transmitter unit for this purpose.

If the remote transmitter unit requires two successive button depressions for executing the command, a second depression of the remote transmitter unit would be made, and would generate additional 58 bytes of data in the routine of block 350 in FIG. 6. However, if a second depression of the transmitter unit is not required during the Operational mode, then the 58 bytes of data produced during the routine of block 350 in the Learn Mode would also be used during the Operational mode.

After the routine of block 360 in FIG. 6 has been completed, the microprocessor then proceeds to perform the routine of block 370 to determine whether the command signal during the Operational mode matches the unique coded signal stored during the Learn Mode. The manner is which this routine is performed is more particularly illustrated by blocks 371–374 in FIG. 6D.

Figure 6E:
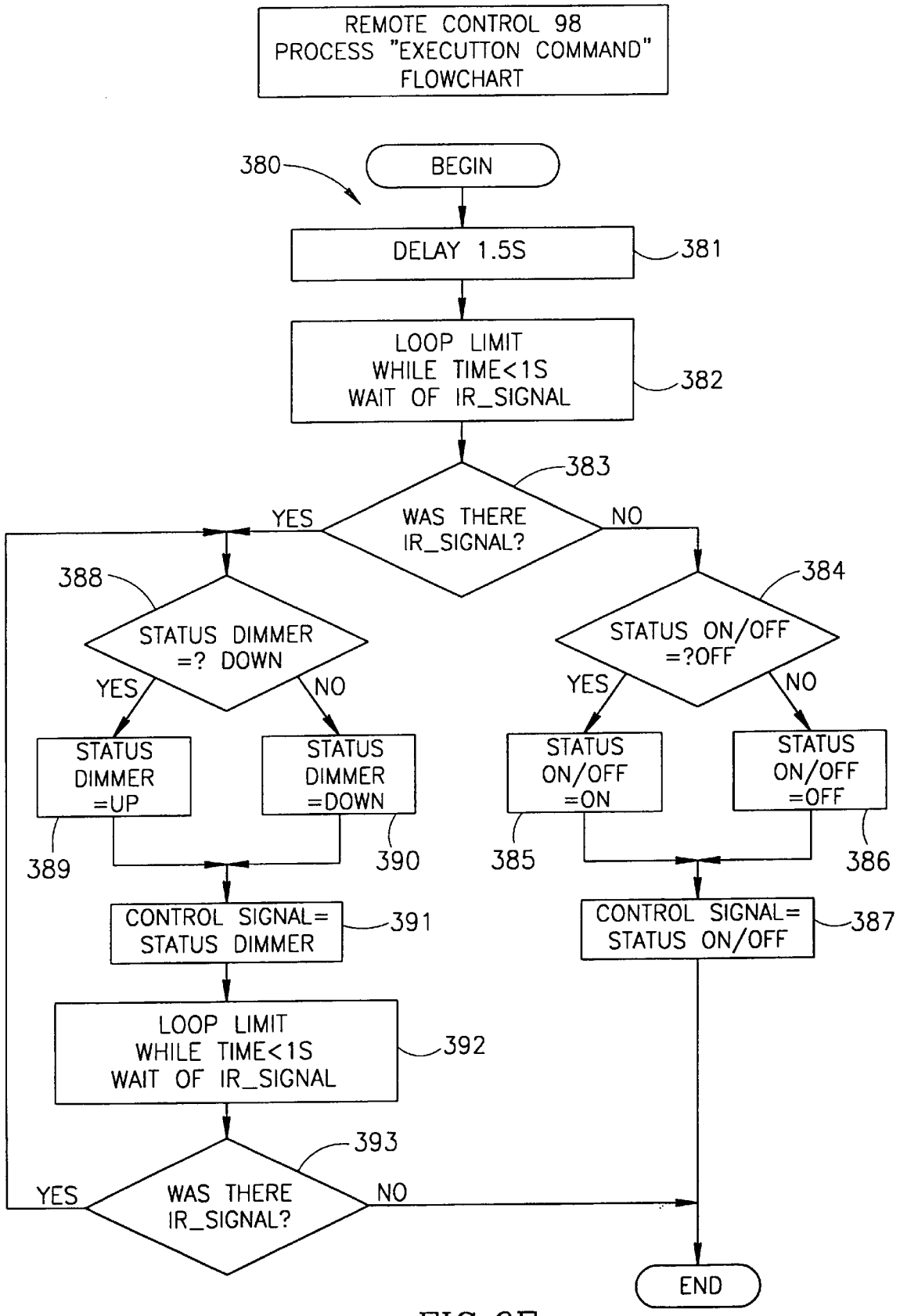

When the received command signal is recognized as matching that stored in the memory, the software then proceeds to execute the command according to the routine shown by block 380 in FIG. 6, and more particularly illustrated by blocks 381–393 in FIG. 6E. Thus, the microprocessor first determines whether this command signal is greater than 1.5s (blocks 381–383). If not, the software executes merely an On-Off control function with respect to the electrical appliance (blocks 384–387); but if the command signal is greater than 1.5s, the software executes a Dimmer control with respect to the electrical appliance (blocks 388–393).

While the invention has been described with respect to several preferred embodiments, it will be appreciated that these are set forth merely for purposes of example, and that many other variations, modifications and applications of the invention may be made.

What is claimed is:

1. A method of controlling an electrical appliance by means of a command signal transmitted by a particular remote control transmitter, comprising:

providing a converter device which includes a receiver for receiving said command signal, a microprocessor for converting said command signal, according to a predetermined conversion process comparable with various types of command signals, to a code unique to that particular remote control transmitter, and a storage device for storing said unique code;

transmitting to said converter device a command signal from said particular remote control transmitter while said microprocessor is programmed in a Learn Mode to convert said command signal according to said predetermined conversion process to said unique code, and to store said unique code in said storage device;

and subsequently transmitting to said converter device another command signal from said particular remote control transmitter, while said microprocessor is programmed in an Operational Mode, to convert said latter command signal to a code according to said predetermined conversion process, to compare said latter code with the code produced and stored during said Learn Mode, and to effect said control of the electrical device when a match is found to be present between the code produced and stored during the Learn Mode and the code produced during the Operational Mode;

wherein said command signal is a pulse-width-modulated signal, and said predetermined conversion process senses the rising points, the falling points, and the width of the pulse in said pulse-width-modulated signal to convert the command signal to said unique code;

wherein said microprocessor is programmed to execute said Learn Mode in at least two stages, including a first stage in which it detects the widths of the pulses and spaces in the command signal, and a second stage in which it detects the rising points and the falling points of the pulses in the command signal;

wherein said microprocessor is programmed to execute said Learn Mode in an additional third stage, said third stage being a repetition of said second stage but applicable to process a second command signal transmitted by a remote control transmitter immediately subsequently to the transmission of the command signal processed in said second stage.

2. The method according to claim 1, wherein said predetermined conversion process utilizes the changes in the rising points, the falling points, and the length of the pulses in said pulse-width-modulated signal to convert the command signal to said unique code.

3. The method according to claim 1, wherein said microprocessor is programmed to execute said Learn Mode in at least two stages, including a first stage in which it detects the widths of the pulses and spaces in the command signal, and a second stage in which it detects the rising points and the falling points of the pulses in the command signal.

4. Apparatus for controlling an electrical appliance by means of a command signal transmitted by a particular remote control transmitter, comprising:

a converter device including a receiver for receiving said command signal, a microprocessor for converting said command signal, according to a predetermined conversion process compatible with various types of command signals, to a code unique to that particular remote control transmitter and a storage device for storing said unique code;

said microprocessor being programmed to execute a Learn Mode when receiving, during the Learn Mode, a first command signal transmitted by said particular remote control transmitter to convert said first command signal to said unique code according to said predetermined conversion process, and to store said unique code in said storage device;

said microprocessor also being programmed to execute an Operational Mode when receives, during the Operational mode, a second command signal from a remote control transmitter, to convert said second command signal to a code according to said predetermined conversion process, to compare said latter code with the code produced and stored during said Learn Mode, and to effect said control of the electrical device when a match is found to be present between the code produced and stored during the Learn Mode and the code produced during the Operational Mode;

wherein said command signal is a pulse-width-modulated signal, and said predetermined conversion process senses the rising points, the falling points, and the width of the pulse in said pulse-width-modulated signal to convert the command signal to said unique code;

wherein said microprocessor is programmed to execute said Learn Mode in at least two stages, including a first stage in which it detects the widths of the pulses and spaces in the command signal, and a second stage in which it detects the rising points and the falling points of the pulses in the command signal;

wherein in the first stage, the widths of the pulses and spaces in the command signal are classified in a plurality of different classes; and in the second stage, each change in a rising point and each change in a falling point of a pulse are combined with the class of the respective pulse as classified in the first stage.

5. Apparatus for controlling an electrical appliance by means of a command signal transmitted by a particular remote control transmitter, comprising:

a converter device including a receiver for receiving said command signal, a microprocessor for converting said command signal, according to a predetermined conversion process compatible with various types of command signals, to a code unique to that particular remote control transmitter and a storage device for storing said unique code;

said microprocessor being programmed to execute a Learn Mode when receiving, during the Learn Mode, a first command signal transmitted by said particular remote control transmitter to convert said first command signal to said unique code according to said predetermined conversion process, and to store said unique code in said storage device;

said microprocessor also being programmed to execute an Operational Mode when receives, during the Operational mode, a second command signal from a remote control transmitter, to convert said second command signal to a code according to said predetermined conversion process, to compare said latter code with the code produced and stored during said Learn Mode, and to effect said control of the electrical device when a match is found to be present between the code produced and stored during the Learn Mode and the code produced during the Operational Mode;

wherein said command signal is a pulse-width-modulated signal, and said predetermined conversion process senses the rising points, the falling points, and the width of the pulse in said pulse-width-modulated signal to convert the command signal to said unique code;

wherein said microprocessor is programmed to execute said Learn Mode in at least two stages, including a first stage in which it detects the widths of the pulses and spaces in the command signal, and a second stage in which it detects the rising points and the falling points of the pulses in the command signal;

wherein said microprocessor is programmed to execute said Learn Mode in an additional third stage, said third stage being a repetition of said second stage but applicable to process a second command signal transmitted by a remote control transmitter immediately subsequently to the transmission of the command signal processed in said second stage.

6. The apparatus according to claim 4, wherein said predetermined conversion process utilizes the changes in the rising points, the falling points, and the length of the pulses in said pulse-width-modulated signal to convert the command signal to said unique code.

* * * * *